US005735318A

United States Patent [19]

Vianello

[11] Patent Number: 5,735,318

[45] Date of Patent: Apr. 7, 1998

[54] AUTOMATIC METHOD AND DEVICE FOR FILLING INSULATING GLAZING UNITS

[75] Inventor: Fortunato Vianello, Vallio Di Roncade, Italy

[73] Assignee: For.El. Base di Vianello Fortunato & C. S.n.c., Vallio di Roncade, Italy

[21] Appl. No.: 545,275

[22] Filed: Oct. 19, 1995

[30] Foreign Application Priority Data

Oct. 28, 1994 [IT] Italy ..... TV94A0125

[51] Int. Cl.[6] ..... B65B 1/09; B65B 1/16; B65B 3/08; B65B 3/10

[52] U.S. Cl. ..... 141/67; 141/4; 141/59; 141/63; 141/66; 141/129; 141/164; 141/165; 141/236; 53/403; 156/104; 156/105; 156/106

[58] Field of Search ..... 141/4, 59, 63, 141/66, 129, 164, 165, 236, 67; 53/403; 156/99, 102, 104, 105, 106; 29/525, 897.32

[56] References Cited

U.S. PATENT DOCUMENTS

| | | | |
|---|---|---|---|
| 4,144,684 | 3/1979 | Kirkbride et al. | 52/204 |
| 4,261,145 | 4/1981 | Brocking | 29/525 |
| 4,357,744 | 11/1982 | McKenzie et al. | 29/525 |
| 4,886,095 | 12/1989 | Lisec | 141/66 |
| 4,921,022 | 5/1990 | Lisec | 53/403 |

FOREIGN PATENT DOCUMENTS

| | | |
|---|---|---|
| 0 043 476 | 1/1982 | European Pat. Off. . |
| 0 046 847 | 3/1982 | European Pat. Off. . |
| 0 603 148 | 6/1994 | European Pat. Off. . |
| 9 314 291 | 7/1993 | WIPO . |

*Primary Examiner*—Henry J. Recla
*Assistant Examiner*—Timothy L. Maust
*Attorney, Agent, or Firm*—Guido Modiano; Albert Josif

[57] ABSTRACT

An automatic method and device for filling, with gases other than air, insulating glazing units. The method entailing a step for injecting the gas and expelling the air so as to produce a laminar flow through a manifold constituted by the hollow region of the profile that forms the spacer frame. The method and the device allow a considerable saving in costs, reducing the amount of gas required for filling to an amount very close to the volume of the inner space provided in the insulating glazing unit.

23 Claims, 6 Drawing Sheets

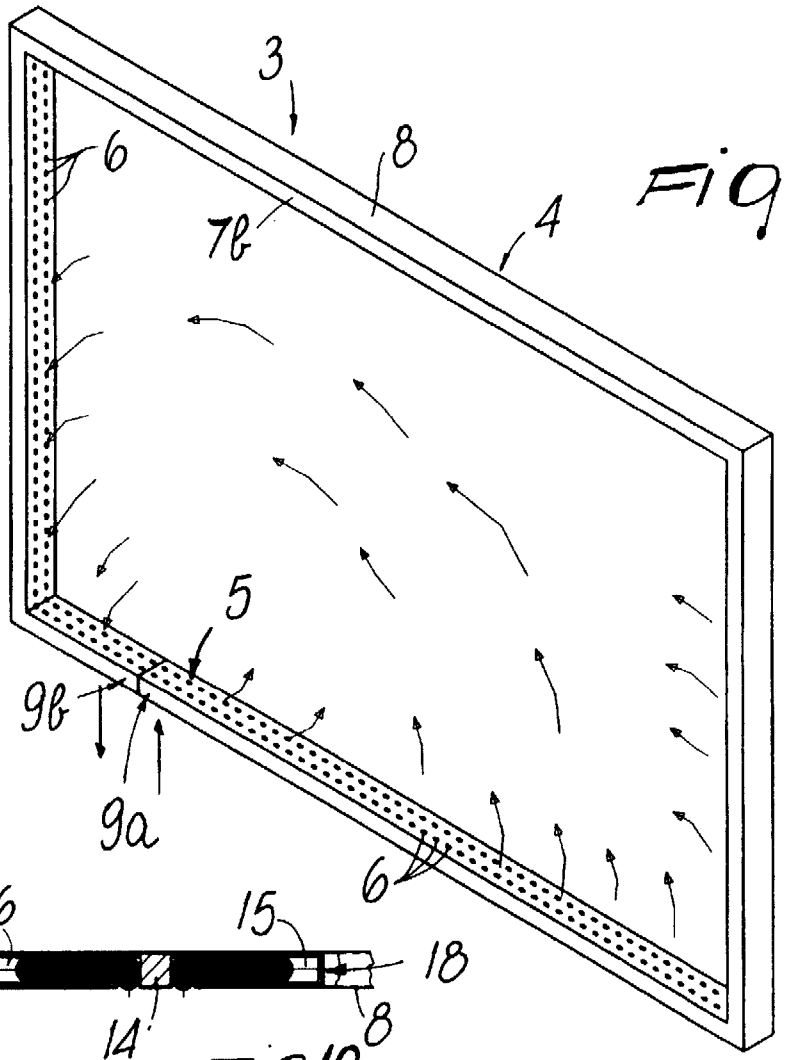
Fig. 5
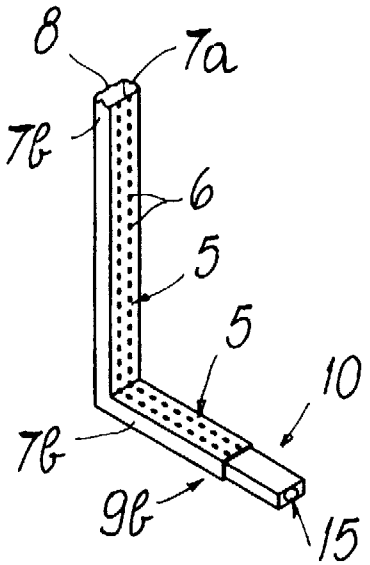
Fig. 6
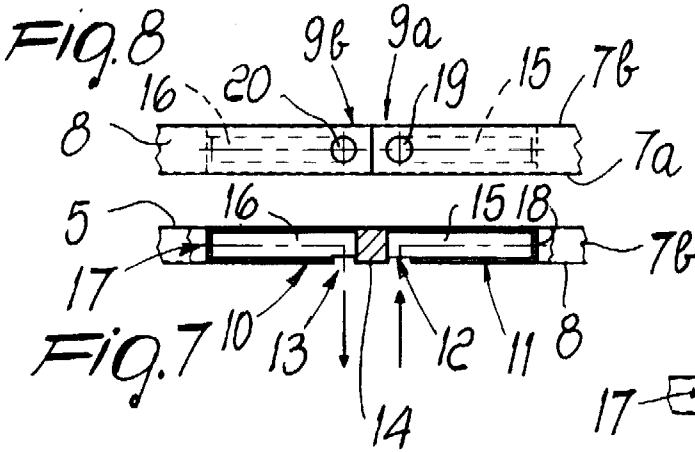
Fig. 8
Fig. 7
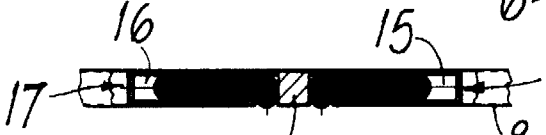
Fig. 10

AUTOMATIC METHOD AND DEVICE FOR FILLING INSULATING GLAZING UNITS

BACKGROUND OF THE INVENTION

The present invention relates to an automatic method and device for filling insulating glazing units with a gas other than air.

Conventional methods are currently divided into manual and automatic methods.

Manual methods can be based on the concept of measuring the gas flow and its injection time, or on the principle of measuring the gas concentration inside the insulating glazing unit during its injection.

In automatic methods usually the gas concentration inside the insulating glazing unit during its injection is measured.

Accordingly, a manual method based on flow and time is known: in this method, the spacer frame of the insulating glazing unit is perforated beforehand, either before or after coupling to the glass plates, but preferably before, in order to prevent shavings from entering the inner space of the insulating glazing unit, in appropriate positions used respectively to inject gas and to vent the air/gas mix, which becomes gradually richer in gas.

A laminar-flow working condition is produced and the gas is injected through a first hole, which is located for example in the lower part of the insulating glazing unit; the gas has a higher relative density than air and therefore it mixes to a relatively limited extent with the overlying air, which is accordingly moved and expelled through a second hole located for example in the upper part of the insulating glazing unit.

The gas motion front in any case entails a certain turbulence, so that the gas mixes with the air nonetheless; accordingly, expulsion through the second vent hole partially affects the injected gas as well.

By measuring the flow, time, and volume of the inner space of the insulating glazing unit it is possible to calculate when to interrupt the gas flow and seal as quickly as possible the first injection hole and the second vent hole.

The uncertainty is related to the dynamics of the formation of a gas/air mixture, which entails the discharge of a part of the gas diluted in the air, which in theory is the only component to be expelled, and entails that the air contained in the inner space of the insulating glazing unit dilutes the gas that has entered.

In order to approximately take into account the interference that is intrinsic to this mixing process, it is possible to introduce a multiplying coefficient, for example equal to approximately two, in calculating the time required to theoretically fill the insulating glazing unit with gas.

Generally, filling stations are capable of simultaneously handling one to six filling positions.

The operations are fully manual, except (at the most) for the automatic closure of the gas feed valve and for the energization of an alarm that warns the operator for sealing the openings formed on the spacer frame.

This sealing action must be prompt, otherwise the great difference between the partial pressures of the gas inside the insulating glazing unit and of the air on the outside, as well as the macroscopic size of the holes formed in the spacer frame for feeding and venting, cause rapid escape of the filler gas.

A manual method based on measuring the gas concentration is also known; it entails a procedure, as regards the preparation of the frame, the injection of the gas, and the expulsion of the air/gas mix, that is identical to what has been described above, except for the additional configuration of having a probe provided with a sensor connected to appropriate instruments for analyzing the concentration of the gas or of the oxygen contained in the inner space of the insulating glazing unit.

Said probe is inserted through the second vent hole, if the size of said hole is sufficient for both functions, or is applied to a third opening provided for this specific purpose.

The attainment of the end of the cycle, the optional closing of the gas feed valve, and the optional alarm that calls for the intervention of the operator are therefore not based on a theoretical calculation of filling completion but are based on the actual attainment of the desired gas concentration in the inner space of the insulating glazing unit.

Generally, filling stations can simultaneously handle one to six filling positions.

This known method essentially suffers a great drawback; it must in fact be noted that there is a pressing need to save on the consumption of gas in industries producing insulating glazing units, since the use of gases having for example sound-absorbing characteristics is increasingly widespread, and the costs of such gases are an order of magnitude higher than those previously used, for which first-generation automatic filling machines had been marketed.

Architectural projects for residential areas proximate to airports and to large public and hotel complexes cannot do without insulating glazing units filled with gases having soundproofing characteristics.

The competitive production of these insulating glazing units filled with gases having soundproofing characteristics cannot therefore be of the previously described manual type.

An automatic method is therefore known based on measuring gas concentration; since automation requires to be able to fill the inner space of the insulating glazing unit in a station included in the line for the automatic production of said unit, various methods have been developed.

However, the goal of all these known methods has been to perform filling in a time that is equal to, or shorter than, the time of the longest step of the automatic production cycle.

As a consequence thereof, it has been observed that all these known processes entail that the gas is fed into the inner space of the insulating glazing unit in a turbulent condition; the consequent process therefore entails displacement by dilution, that is to say, the effect of each introduction of a volume of filling gas equal to the volume of the inner space is to halve the concentration of the air that is present at that time inside the insulating glazing unit.

As a more specific example, each introduction of a volume of gas equal to the volume of the inner space entails the following progression in the concentration of air inside the insulating glazing unit: ½, ¼, ⅛, 1/16, 1/32 . . . ; in other words, as many as 5 volumes of gas are required to reduce the concentration of the air inside the insulating glazing unit to 3%, with a consequent waste of said gas; otherwise it is necessary to accept much higher concentrations.

When using argon gas (the most widely used gas in the initial stages of the development of the technology of insulating glazing unit filling), the problem of gas waste was economically sustainable (since the lire/liter ratio was approximately 10), but when using the SF6 gas (currently used to achieve an attenuation of acoustic transmission of up to 3 dB(A)), the incidence of the corresponding cost (approximately 100 lire/liter) no longer allows to accept the waste that is typical of currently commercially available automatic filling machines.

The automatic systems that have become widespread up to now therefore have the problem of excessive gas consumption, which can be quantified as being even from four to five times the volume of the inner space enclosed in the insulating glazing unit.

Another drawback is furthermore observed: the holes for injecting the gas and for expelling the air tend to compromise the tightness of the spacer frame to water vapor and to gases.

Italian patent no. 1,142,062, filed on Nov. 23, 1981 and claiming an Austrian priority dated May 26, 1981, is known; it discloses a device for filling insulating glazing units with heavy gas, such as for example sulfur hexafluoride, which comprises two plates arranged substantially vertically on the two sides of the insulating glazing unit to be filled; at least one of said plates is movable transversely with respect to its plane.

Said device is characterized in that a gasket is located on the horizontal upper edge and that gaskets are located on the vertical edges; in that said gaskets, in their sealing position, are movable, and below the plates a tank-shaped container is provided, having in an upward region an opening and in which the edges are hermetically connected to the plates; and in that the bottom of the tank-shaped container is associated with a system for lifting the bottom.

The device is intrinsically complicated, since it requires particular solutions for tightness; furthermore, it is necessary to use such an amount of gas as to also saturate the volume that is not occupied by the glass plate (and therefore the intermediate space, designated by the reference numeral 8 in the text); this excess gas is partially vented during the incoming and outgoing transit of the insulating glazing unit.

European patent EP 0276647, claiming an Austrian priority dated Jan. 15, 1987, is also known; it discloses a device in which a pressure is applied to the outer surfaces of the glass plates of an insulating glass unit to be filled while its inner space is being filled with gas, activating a device provided with a system for conveying the filler gas and with a system for discharging the air and/or the gas from the inside of the insulating glazing unit.

Two pressure plates are furthermore provided which can be arranged against the outer surfaces of the glass plates of the insulating glazing unit during the operation for filling at a preselected pressure.

This known solution, too, has some of the drawbacks described above, particularly residing in the high specific consumption of gas, since working occurs in turbulent conditions.

Other drawbacks are essentially constituted by the fact that the gas must be introduced between the glass plates through at least one inlet and that the air or mixture of air and gas must be discharged from the inside through at least one other opening; both of these openings are formed by producing a through hole at the surfaces of the spacer frame that are arranged at right angles to the glass plates: this entails performing an additional machining operation on the spacer frame and the difficulty of sealing said openings, since the sealant might leak out at the surface of the spacer frame that lies inside the inner space.

European patent EP 0324333, claiming an Austrian priority dated Jan. 11, 1988, is also known; it discloses a device for filling an insulating glazing unit with special gas by means of a probe for injection and two probes for venting, which can be inserted through three openings formed in the spacer, and with a device for closing said openings in the spacer once the filling operation has been completed: the probe and the device are located on the exit side of a device adapted to apply pressure to the insulating glazing units.

Both the probes and the device for closing the openings are located on a common structural element, which is movable from a protruding position under the conveyor belt for the insulating glazing unit into a first active position, in which the probe of the filling inlet is located inside the spacer, and then into a second active position, in which the device for closing the openings is located inside the spacer: the probe located on the structural element of the surface for conveying the insulating glazing unit is located in such a manner so as to be movable forwards and backwards.

This device, too, has some of the mentioned drawbacks, including that it needs an opening for the insertion of the probe and openings on the spacer frame that are obtained by providing through holes, with the above mentioned drawbacks; furthermore, these openings require a particular device to close them, and this is not always easy and optimum.

In any case, a high consumption of gas is observed, since said gas is injected in turbulent conditions.

European Patent EP 0444391 is also known; in this patent, in order to fill the inside of an insulating glazing unit with gas, such as for example argon, when the plate is press-molded it is kept spaced from the spacer frame by moving a part of the molding plate, with the aid of suckers; a crack is thus formed, through which a probe for feeding the argon gas and a probe for aspirating air from inside the glazing unit are inserted.

The gas feed probe is arranged parallel to the lower horizontal side of the glazing unit, whereas the probe for aspirating the air and the mixture of air and gas is tilted upwards to prevent the formation of through holes in the spacer frames, and with a replacement of the gas that allows a limited mixing of the gas with the air originating from inside.

However, even this solution has drawbacks, such as the turbulent condition of the process, which is necessarily fast in order to avoid affecting the working timings of the line for the production of the insulating glazing units.

Furthermore, the presence of the crack entails a possible considerable dispersion of gas, with a consequent cost increase.

European Patent EP 0603148 is also known; in this patent, the insulating glazing units are filled with gas while the unit is substantially arranged in a vertical fixed position so that one of the two glass plates constituting it is coupled only at its upper horizontal rim to the spacer frame, which is located on the other glass plate; the horizontal lower edge is spaced from the spacer frame and is open, whereas both vertical edges of the insulating glazing unit are also at least partially open and are closed hermetically.

The filling gas is introduced in the glazing unit in the region of one vertical edge, and the air or mixture of air and gas is discharged through the opposite vertical open edge of the insulating glazing unit.

However, even this solution has drawbacks, since excessive gas consumption occurs.

The use of presses adapted to keep the plates of the unit in an appropriate position in some of the mentioned conventional methods is justified by the high injection pressures of the gas, which can have a flow-rate of up to approximately 40 liters per second; therefore, before sealing the through openings formed on the unit it is necessary to wait for the inner space of said unit to return to ambient pressure, on penalty of the possible explosion of the plates or their deformation.

SUMMARY OF THE INVENTION

A principal aim of the present invention is therefore to solve the described technical problems, by eliminating the drawbacks of the mentioned known art and by providing an automatic method and device for filling insulating glazing units with a gas other than air which, differently from the corresponding conventional automatic methods, allows considerable savings as regards filling gas consumption, at the same time allowing to improve the heat insulation and soundproofing characteristics of the units, as well as other properties linked to the filling of the units with a gas other than air.

Within the scope of the above aim, an important object is to provide a device which, despite being inserted in the lines for the automatic production of insulating glazing units, achieves their same productivity and at the same time allows to achieve an acceptable saving in gas consumption.

Another object is to provide a method and a device allowing to fill insulating glazing units automatically and with at least half the specific consumption of gas with respect to the known art for an equal degree of inner space filling.

Another object is to provide a method and a device allowing to maintain the tightness of the spacer frame to water vapor and gases.

Another object is to provide a device allowing to automatically perform optimum filling of the inner space of the glazing unit starting from the condition in which the glass plates are stably coupled to the lateral surfaces of the spacer frame, said plates being simply adjacent to lateral supporting means without cooperating with presses to maintain their parallel arrangement.

This aim, these objects, and others which will become apparent hereinafter are achieved by an automatic method for filling, with gases other than air, insulating glazing units constituted by two glass plates between which a spacer frame is interposed, said spacer frame being sealed on its lateral edges to the two adjacent glass plates and forming an inner space; characterized in that it comprises a step for injecting the gas between said two glass plates so as to produce a substantially laminar flow and an air expulsion step, both of said steps occurring by means of a manifold constituted by the hollow region of the profile that forms said spacer frame; and an automatic device for filling, with gases other than air, insulating glazing units constituted by two glass plates between which a spacer frame is interposed, said spacer frame being sealed on its lateral edges to the two adjacent glass plates so as to form an inner space, said device comprising a station for conveying said two glass plates after their coupling to said spacer frame; characterized in that it comprises at least one means for coupling one or more nozzles at at least one insert for joining and closing said spacer frame which has at least two adapted holes, with a dividing wall interposed, said holes being formed only on the side lying outside said inner space, said holes allowing access to a manifold constituted by the hollow region of the profile that forms said spacer frame and being sealable automatically after filling has occurred.

BRIEF DESCRIPTION OF THE DRAWINGS

Further characteristics and advantages of the invention will become apparent from the following detailed description of a particular but not exclusive embodiment thereof, illustrated only by way of non-limitative example in the accompanying drawings, wherein:

FIG. 5 is a lateral perspective view of the spacer frame;

FIG. 6 is a partially sectional lateral perspective view of one end of the spacer frame, with the joining and closing insert associated therewith;

FIG. 7 is a longitudinal sectional view of the joining and closing insert;

FIG. 8 is a bottom view of the unit at the joining insert for the spacer frame;

FIG. 10 is a sectional view of the holes after sealing them.

DESCRIPTION OF THE PREFERRED EMBODIMENTS

Figure 1:
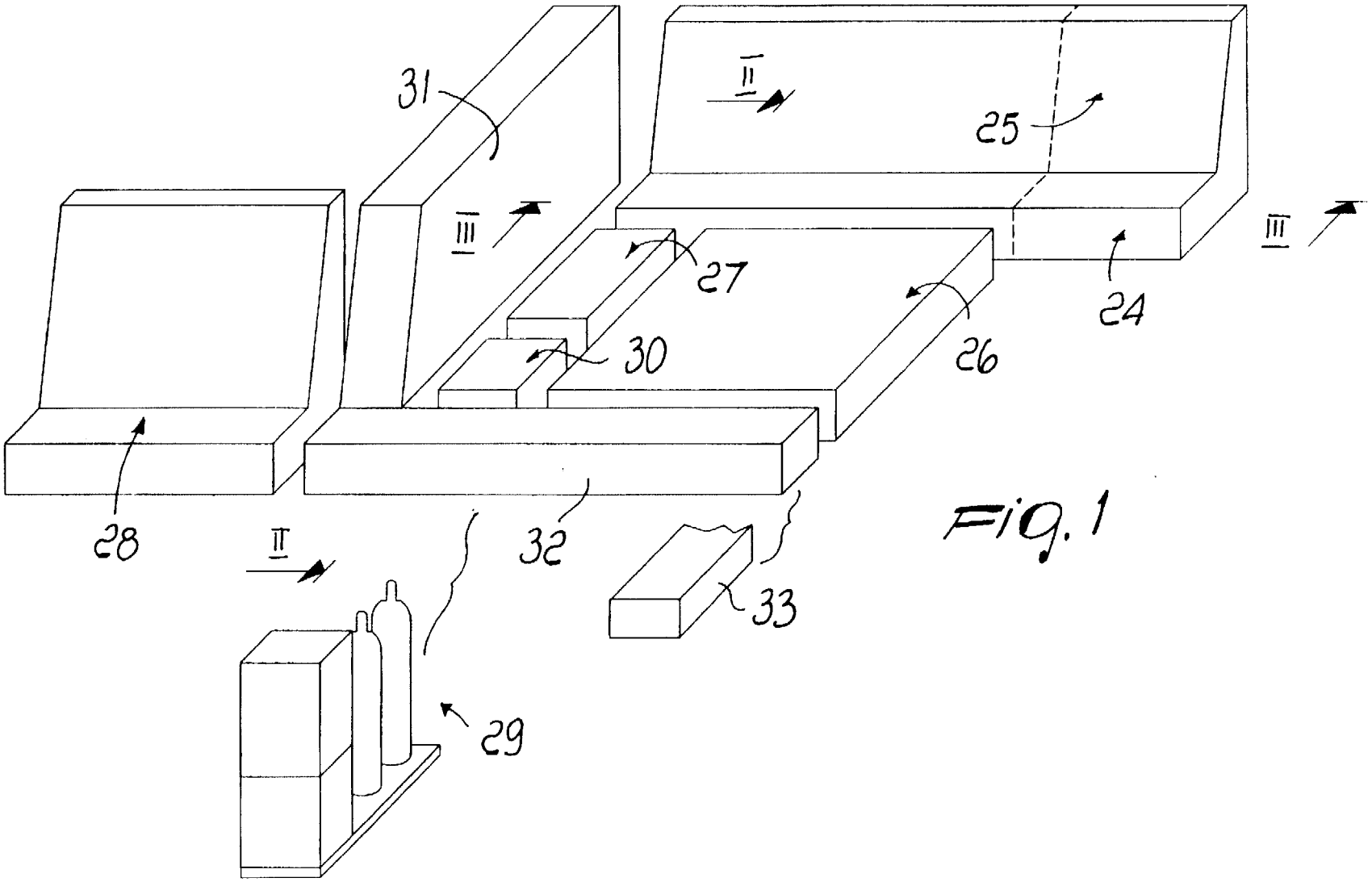
FIG. 1 is a schematic view of the components of the device.
Figure 2:
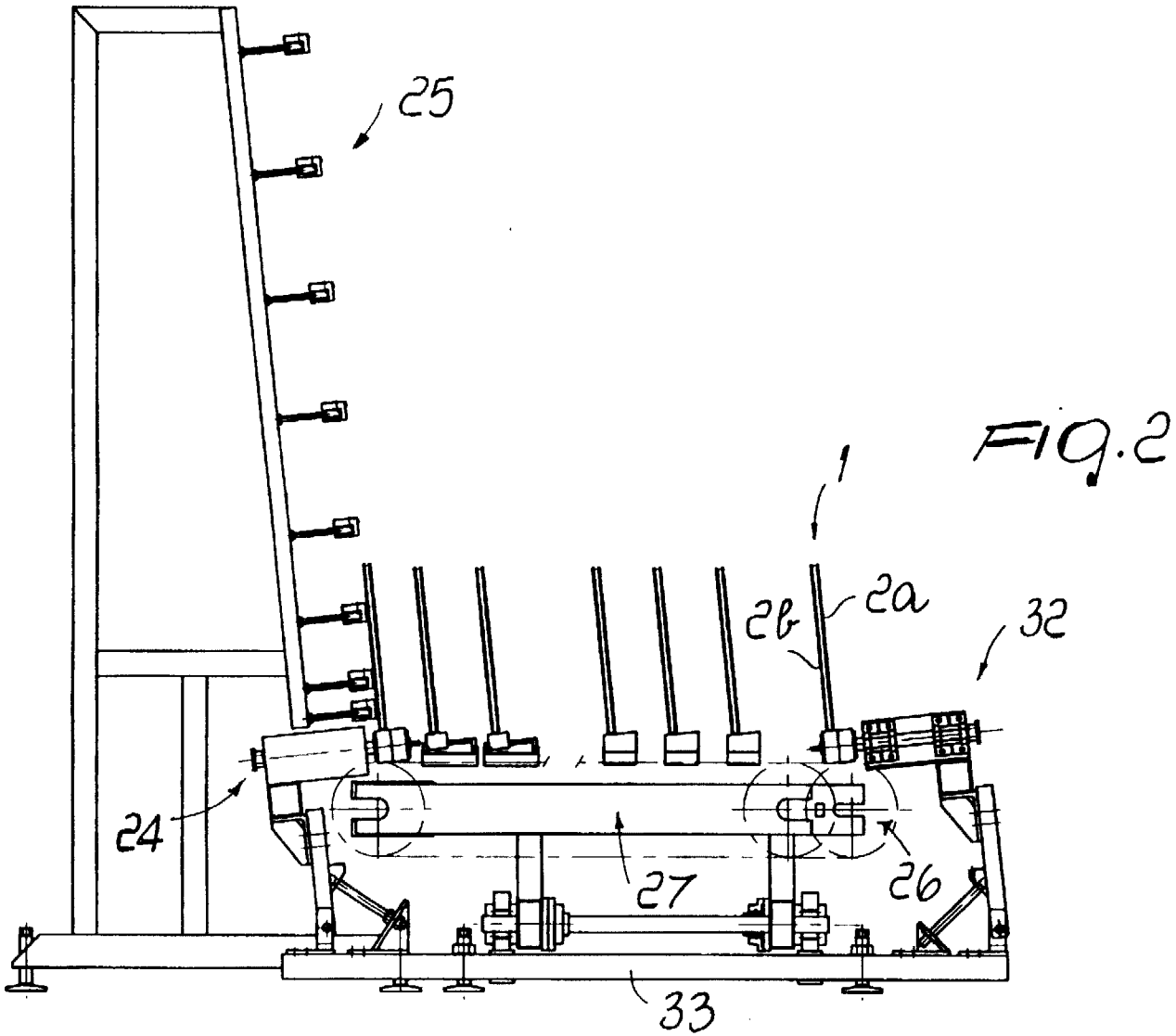
FIG. 2 is a sectional view of the device, taken along the plane II—II of FIG. 1.
Figure 3:
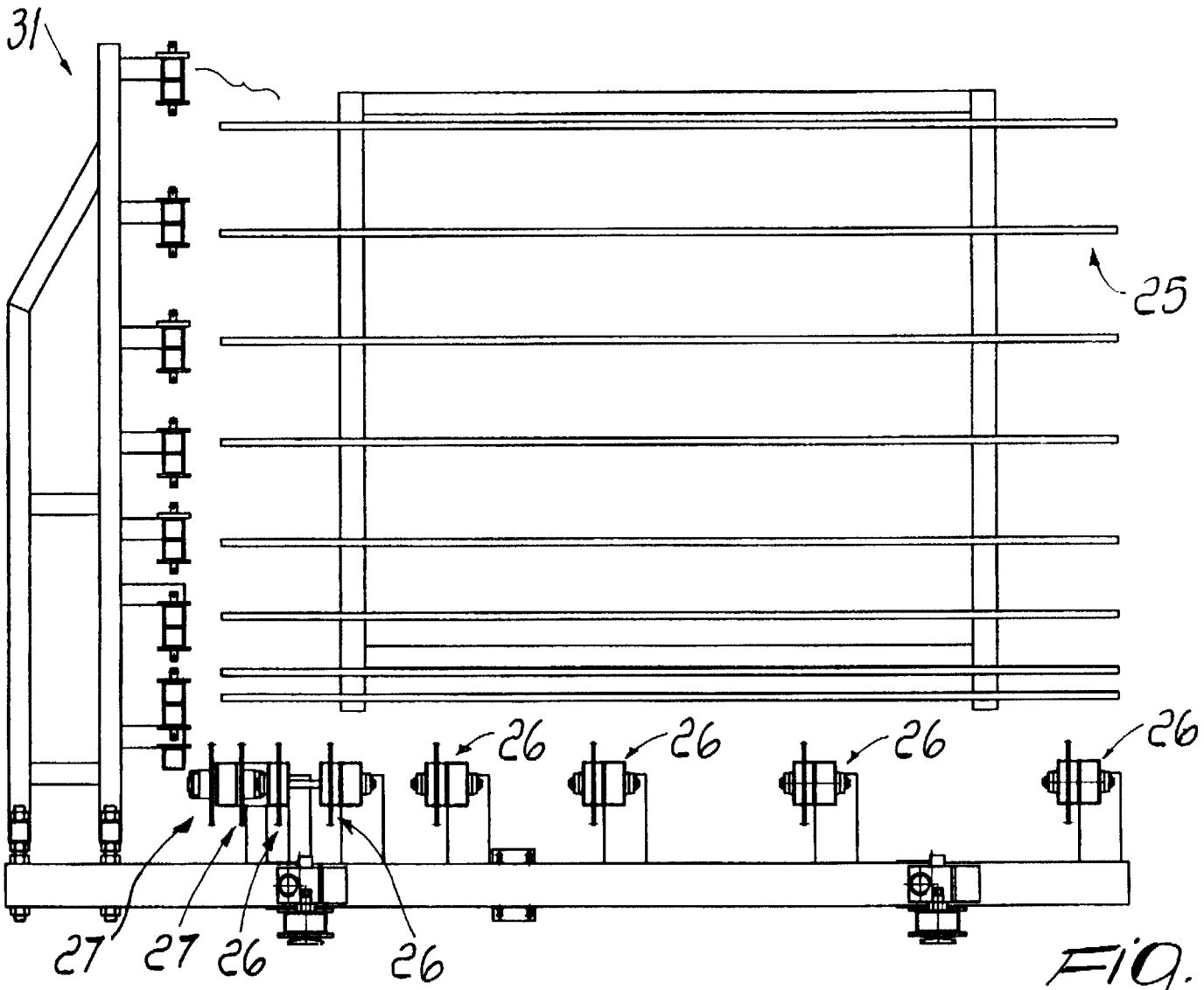
FIG. 3 is a sectional view of the device, taken along the plane III—III of FIG. 1.
Figure 4:
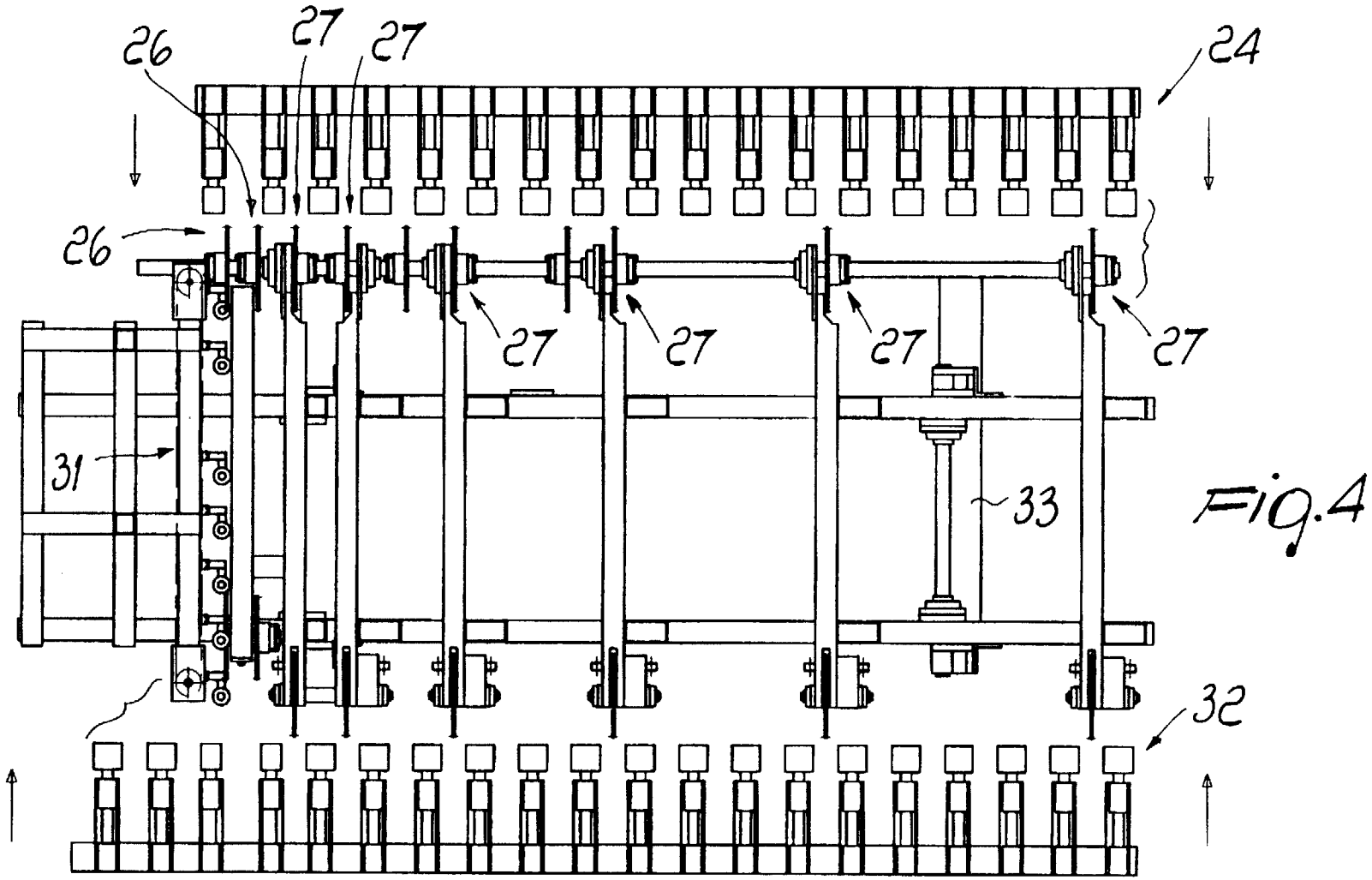
FIG. 4 is a top view of the device.
Figure 11:
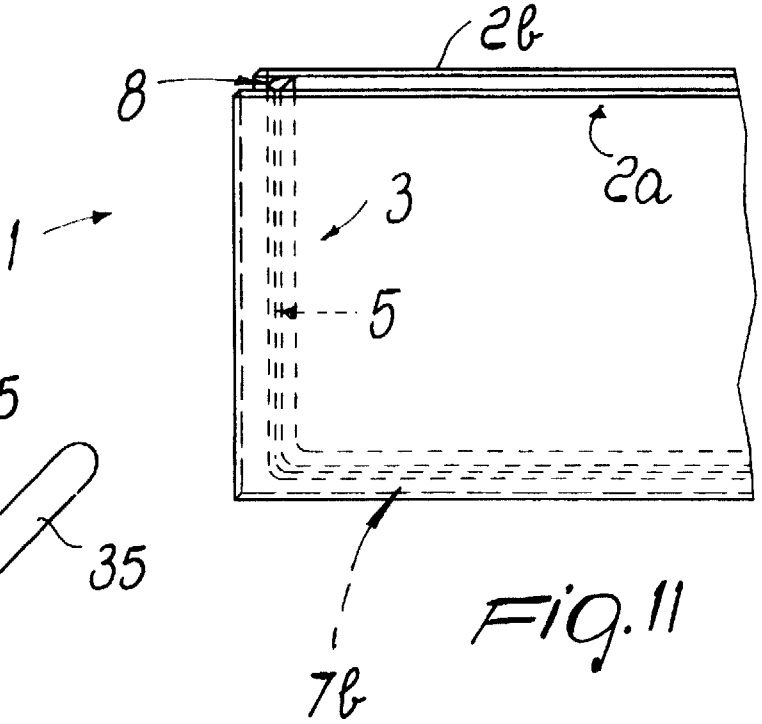
FIG. 11 shows the two glass plates with interposed a spacer frame.

With reference to the above figures, the reference numeral 1 designates an insulating glazing unit, constituted by two glass plates 2*a*, 2*b* between which a spacer frame 3 is interposed; said spacer frame is constituted by an internally hollow profile 4 a first surface 5 that faces the inner space formed together with the two glass plates 2*a* and 2*b* and on which a plurality of small holes 6 are formed.

Second lateral surfaces 7*a* and 7*b* are adjacent to the first surface 5, and a first seal for coupling to the glass plates 2*a* and 2*b* is formed at said second surfaces.

A third surface 8 lying outside the inner space is provided on the opposite side with respect to the first surface 5; a second seal is formed at said third surface.

The profile 4 of the spacer frame 3 is folded so as to form a polygon and can be coupled, at the joining ends 9*a* and 9*b*, to an insert 10 for joining and closing the profile 4 of the spacer frame 3.

Said insert 10 can then be inserted at the hollow region of the profile so as to keep the ends 9*a* and 9*b* mutually adjacent.

At the surface 11 that is adjacent to the third surface 8 of the profile 4 directed away from the inner space, said insert 10 has a first hole 12 and a second hole 13, between which a dividing wall 14 is interposed.

The first hole 12 and the second hole 13 are connected respectively to a first channel 15 and to a second channel 16 formed axially to the insert 10 and therefore in turn connected to the hollow internal region of the profile 4 of the spacer frame 3.

Said first and second ducts preferably respectively have, at their end lying opposite to the first and second holes, a first filter 17 and a second filter 18 that are adapted to prevent the escape of the salt grains contained within the profile 4 through said ducts.

A third hole 19 and a fourth hole 20 are formed on the third surface 8 of the profile 4 proximate to the end 9*a* and 9*b* and at the same axis as the first hole 12 and the second hole 13; said third and fourth holes or openings allow, by virtue of a means 21, the coupling of one or more nozzles 34 at the first hole 12 and at the second hole 13.

Said means 21 is advantageously constituted by a slider 22 movable along bars 35 arranged transversely with respect to the plane of arrangement of the glass plates 2*a* and 2*b*; a mechanism is provided on said slider 22 and comprises a butterfly-shaped element 23 adapted to be centered at the centerline of the third surface 8 of the profile 4.

An additional mechanism runs, along said axis, on guides arranged at right angles to said bars and places said nozzles 34 respectively at the first hole 12 for the injection of gas and at the second hole 13 for venting the air contained in the inner space.

Adapted microvalves, preferably contained inside the slider 22 itself, allow to open the gas injection duct only when the nozzles and the third and fourth holes formed on the profile 4 are coupled.

The complex of all these elements and mechanisms, which constitute the filling device, is arranged along a transmission chain as many times as there are intended stations for filling panels 1, except for one, which is meant to produce the second seal of the glazing unit and to unload it.

The glazing unit, after the coupling of the plates 2*a* and 2*b* by means of the first seal at the second lateral surfaces 7*a* and 7*b* of the spacer frame 3, is supported in a downward region by means of a first roller conveyor 24 and a first rack 25 located at the exit of the coupling device, so as to arrange the glazing units at a first conveyor 26 and at a second conveyor 27 for movement along an axis lying essentially at right angles to the previous conveyance axis.

The first conveyor 26 essentially constitutes an accumulation buffer for the glazing units 1, and this allows, in the industrial process, to comply with the timings for mutually coupling the glass plates 2*a* and 2*b* and the spacer frame 3 before filling and then convey the gas-filled glazing unit at an adapted second rack 28 for conveying the filled glazing unit to the sealing machine along an axis that is preferably approximately parallel to the axis of the first rack 25.

The second conveyor 27 has the same functions as the first conveyor 26 and operates in step therewith but contains the various means 21 for automatic coupling to the first, second, third, and fourth holes formed on the profile 4 and on the insert 10, so as to allow to inject the gas and vent the air contained in the inner space of the glazing unit.

The coupling means 21, located in the second conveyor 27, are actuated by adapted spring-loaded mechanisms controlled by the movement of the conveyor chain during activity with the insulating glazing unit, and by pneumatic cylinders located in the inactive position during reloading of the spring-loaded mechanisms.

The gas is preferably fed to the coupling means 21 by virtue of a deformable loop that runs together with the conveyor chain and is connected to the feed control unit by means of a rotating coupling.

A weighted governor valve prevents the formation of excessive pressure in the inner space of the insulating glazing unit and an alarm reports its intervention in order to eliminate the malfunction that caused it and to restore a condition without vent gas leakage.

A feed control unit 29 is also provided for storing, mixing, and analyzing the gas and contains the cylinders with the filling gas, the optional gas mixing station, and a gas analyzer that is contained in the inner space of the insulating glazing unit; said analyzer, preferably adapted to check the residual oxygen at the vent at the second hole 13, can be of the type based on the concept of the paramagnetic cell, that is to say, highly reliable.

Injection of the gas at the third hole 19 and at the first hole 12 allows to feed the gas into the inner space of the glazing unit so as to produce a substantially laminar flow, since the gas flows through the small holes 6 of the profile 4, which constitutes the manifold for the flow of the gas and the discharge of the air.

The gas in fact flows through the first hole 12 and, by passing at the first duct 15, affects the hollow region of the profile 4, expanding inside the inner space through the small holes 6.

A laminar flow is thus produced and therefore the air contained in the inner space exits through the small holes 6 located in a region that is approximately opposite to the gas inflow region: in this manner, the air contained in the inner space is forced through the small holes 6 at the second hole 13 and at the fourth hole 20 and is thus extracted from the inside of the inner space so as to form a substantially laminar flow.

It should be stressed that the use of a spacer frame 3 provided only with the third hole 19 and the fourth hole 20 allows to keep the filler gas inside the inner space in the course of time, since there is discontinuity at the second lateral surfaces 7*a* and 7*b* of the profile 4 where the first butyl seal is produced, and since the holes 12, 13, 19, and 20 can be sealed perfectly because their walls have a valid extension for the adhesion of the sealant; therefore, the provided solution ensures tightness to the gas, which would otherwise flow back towards the outside of said glazing unit, due to the great difference between the partial pressure of the gas inside the inner space of the glazing unit and the partial pressure of the air outside.

A station 30 for analyzing the concentration of the gas fed into the inner space of the glazing unit is furthermore located at the output of the second conveyor 27: in real time, a feedback based on the analog signal of an analyzer controls the stepwise advancement mode of the insulating glazing units so as to control and optimize the process.

Figure 9:
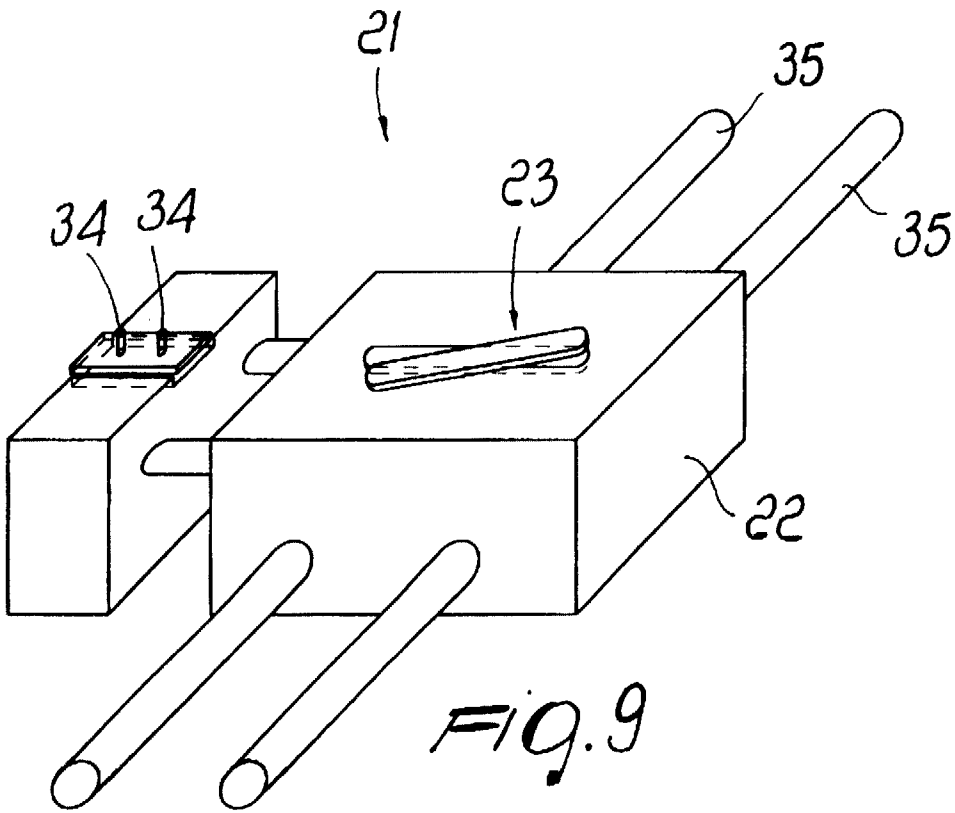
FIG. 9 is a perspective view, of the means for coupling said nozzles at the holes formed on the insert.

After this analysis, which includes an optional additional stop to reach the desired concentration, a sealeant, preferably comprising melted butyl, is injected through adapted nozzles, for example of the type as shown in FIG. 9 (with 34) the first hole 12, the second hole 13, the third hole 19, and the fourth hole 20 being thus automatically sealed hermetically, again at the station 30, as shown in FIG. 10.

It is stressed that this sealing action can be performed in an optimum manner, since the sealant partially or fully closes the first channel or duct 15 and the second channel or duct 16 of the insert 10 and the holes 12, 13, 19, and 20 without altering the aesthetic continuity of the first surface 5 and of the profile 4 that faces the inner space.

The insulating glazing unit 1, while it is being conveyed at the second conveyor 27 at the station 30, can rest at an adapted third conveyor 31 that moves the glazing unit transversely by acting on its vertical edge.

An additional fourth roller conveyor 32 is arranged at right angles to the previous conveyor to transfer the insulating glazing unit at the second rack 28 for subsequent treatments, such as for example the formation of the second seal; if particular insulating glazing sizes and/or thicknesses are used, it is possible to provide an additional upper transverse conveyor.

The reference numeral 33 designates a footing that constitutes the supporting structure for the assembly formed by the first conveyor 26 and by the second conveyor 27.

It has thus been observed that the method and the device have achieved the intended aim and objects, since a finely diffused and therefore laminar flow of the filling gas has been achieved, avoiding any functional contamination, caused for example by sealing, of the first surface 5 of the profile 4 that faces the inner space of the insulating glazing unit.

The achievement of a laminar motion of the incoming gas and of the air escaping through the small holes, by virtue of the particular shape of the insert 10, is very important; furthermore, the tightness to water vapor and to gases of the spacer frame is preserved, since the third hole 19 and the fourth hole 20 coincide with the first hole 12 and the second hole 13 formed on the insert 10 and can thus be easily sealed by virtue of the saturation produced by the butyl at the first duct 15 and at the second duct 12 formed in said insert 10.

The invention is of course susceptible of numerous modifications and variations, all of which are within the scope of the same inventive concept.

The materials and the dimensions that constitute the individual components of the invention may also be the most pertinent according to the specific requirements.

What is claimed is:

1. An automatic device for filling, with gases other than air, insulating glazing units constituted by two glass plates between which a spacer frame is interposed, said spacer frame being constituted by a hollow profile enclosing an inner region, said profile being sealed on lateral edges thereof to said glass plates so as to form an inner space, said device comprising:

a station for conveying said two glass plates after coupling thereof to said spacer frame;

at least one nozzle connectable to said spacer frame;

an insert for joining and closing said spacer frame, said inner region of said hollow profile forming thus a manifold, said insert comprising at least two holes and a dividing wall interposed between said holes, said holes being located on a side of said insert that lies outside said inner space of said glazing unit for providing access from outside to said manifold;

a coupling means for coupling said at least one nozzle to said holes for selectively injecting gas in, and expelling air from said inner space, said holes being further sealable automatically upon ending of the filling.

2. Device according to claim 1, wherein said holes formed on said insert are connected to separate channels for injecting the gas and for discharging the air, complementarily shaped openings being formed, at said holes, on a surface of said spacer frame that lies outside said inner space.

3. Device according to claim 2, wherein said channels have a same axis, a dividing wall being formed between said channels.

4. Device according to claim 3, wherein said channels, connected to said holes, divide said hollow region of said profile that forms said spacer frame into a first region for injecting the gas inside said inner space through small holes provided on a first surface of said spacer frame, and into a second region for discharging the air contained in said inner space, said injection and discharge occurring so as to produce a laminar flow.

5. Device according to claim 4, wherein said at least two holes allow entry of said gas that flows out through said small holes, said small holes being provided on inner sides of said spacer, and said at least two holes allowing further discharge of the air that is present between said two glass plates.

6. Device according to claim 4, wherein said coupling means for coupling said at least one nozzle at said insert are constituted by a slider, said slider being constituted by a mechanism for performing self-centering with respect to a centerline of said first surface of said profile of said spacer frame and consequent subsequent insertion of probes for feeding filler gas and for venting air and air/gas mixture, said coupling means being actuated by actuators for actuating spring-loaded micromechanisms adapted to perform movements caused only by energy produced by springs.

7. An automatic device for filling, with gases other than air, insulating glazing units, said device comprising:

two glass plates;

a spacer frame being interposed between said glass plates for forming an inner space of an insulating glazing unit, said spacer frame being constituted by a profile being internally hollow, said profile being folded for forming a continuous perimetrical structure with joinable ends , said spacer frame comprising a first surface facing said inner space, second lateral surfaces being adjacent to said first surface, and a third surface lying outside said inner space;

a first sealing being provided between said second lateral surfaces and said glass plates;

an insert for joining together said ends of said profile, a continuous inner region of said profile being obtained, said inner region forming a manifold, said insert having, at a surface that lies adjacent to said third surface of said profile that is directed away from said inner space, a first and a second hole, between which a dividing wall is interposed;

a plurality of small holes being provided at said first surface;

means for injecting gas into said manifold, the gas being injected further flowing through said plurality of holes to produce a laminar flow inside said inner space.

8. Device according to claim 7, wherein said first and said second holes are connected respectively to a first and second channels, said channels being formed axially with respect to said insert and being connected to the hollow internal region of said profile of said spacer frame.

9. Device according to claim 8, wherein said first and second channels have, respectively a first filter and a second filter for preventing escape of granules of hygroscopic material contained inside said profile through said channels, said filters being locatable at ends of said channels lying opposite to said first and second holes.

10. Device according to claim 7, wherein a third and a fourth hole are formed on said third surface of said profile, proximate to said ends of said profile and at a same axis as said first and second holes, said third and fourth holes allowing coupling of at least one nozzle at said first and second holes, and wherein said means for injecting gas comprises coupling means for automatically coupling said at least one nozzle at said holes.

11. Device according to claim 10, wherein said coupling means is advantageously constituted by a slider movable along bars, said bars being arranged transversely to a plane of arrangement of said glass plates, a mechanism being provided on said slider, said mechanism comprising a butterfly-shaped element which is centered at a centerline of said third surface of said profile.

12. Device according to claim 11, further comprising, along said centerline, an additional mechanism that runs on guides, said guides being arranged at right angles to said bars and said mechanism arranging said at least one nozzle respectively at said first hole for injection of gas and at said second hole for venting the air contained in said inner space.

13. Device according to claim 12, further comprising adapted microvalves, said microvalves being contained in said slider and allowing to open a gas injection duct of said nozzles only when said at least one nozzle and said third and fourth holes formed on said profile are mutually coupled.

14. Device according to claim 13, wherein said coupling means for coupling said at least one nozzle at said first and second holes and the associated mechanism are arranged along a transmission chain of a known type as many times as adapted stations for filling said glazing units are necessarily provided, except for one station which is provided to produce the second sealing of said glazing units and to unload the glazing units for subsequent treatment.

15. Device according to claim 8, further comprising a station for conveying said two glass plates after coupling them to said spacer frame, a first roller conveyor, and a first rack for lower and lateral support of said glazing units, said roller conveyor and first rack arranging said glazing units at a first and at a second conveyors for movement along an axis lying substantially at right angles to an axis of said first roller conveyor and said first rack.

16. Device according to claim 15, wherein said first conveyor constitutes an accumulation buffer for said glazing units for allowing, in an industrial process, compliance with a timing for producing said first seal between said glass plates and said spacer frame before filling, said device further comprising an adapted second rack and a sealing unit, said second rack conveying said filled glazing unit to said sealing unit along an axis that is preferably approximately parallel to the axis of said first rack.

17. Device according to claim 16, wherein said second conveyor has the same functions as said first conveyor and operates in step therewith, contains said coupling means for the automatic coupling of said nozzles to said first, second, third, and fourth holes formed on said profile and on said insert, so as to allow to inject the gas and vent the air contained in said inner space of said glazing unit.

18. Device according to claim 17, wherein said coupling means for the automatic coupling of said nozzles to said first, second, third, and fourth holes, arranged on said first conveyor, are actuated by spring-loaded mechanisms actuated by movement of the transmission chain during activity with said insulating glazing unit and by pneumatic cylinders arranged in an inactive position during reloading of the spring-loaded mechanisms.

19. Device according to claim 18, wherein the gas is fed to said means for the automatic coupling of said nozzles through a deformable loop that moves together with the transmission chain, said loop being connected to a feed control unit by means of a rotary coupling, a weighted safety governor valve preventing occurrence of excessive pressure in said inner space of said insulating glazing unit, and an alarm for reporting intervention of said valve in order to eliminate malfunction that caused said pressure and restore a condition with no vent gas leaks.

20. Device according to claim 15, wherein a station for analyzing the concentration of the gas introduced in the inner space of the glazing unit is located at an output of said first conveyor, a feedback based on an analog signal of an analyzer controlling, in real time, a stepwise advancement mode of said insulating glazing units so as to perform process control and optimization, hermetic sealing of said first, second, third, and fourth holes being formable automatically at said station, said sealing partially or totally closing first and second channels of said insert.

21. Device according to claim 20, further comprising: a third conveyor, said insulating glazing unit, during movement at said first conveyor of said analysis and sealing station, resting at said third conveyor, said third conveyor moving said glazing unit transversely by acting on a vertical edge thereof; and an additional fourth conveyor, arranged at right angles to the third conveyor, being provided to transfer said insulating glazing unit at said second rack for subsequent treatments, such as said second sealing operation, if particular sizes and thicknesses of insulating glazing unit are used.

22. Device according to claim 7, wherein said ends of said profile are interconnectable in a known manner by any of a weld, and a hermetic adhesive tape, at said second lateral surfaces and at said third surface of said spacer frame.

23. Device according to claim 20, further comprising at least one nozzle, said at least one nozzle being automatically coupleable to said first, second, third and fourth holes for injecting a sealing composition for closing said first and second channels of said insert.

* * * * *